US005209038A

United States Patent [19]

Robbins

[11] Patent Number: 5,209,038

[45] Date of Patent: May 11, 1993

[54] HEAT CHAMBER LINING

[76] Inventor: Michael K. Robbins, 4420 Pine Lake Dr., Medina, Ohio 44256

[21] Appl. No.: 746,737

[22] Filed: Aug. 19, 1991

[51] Int. Cl.[5] ..... E04B 1/74

[52] U.S. Cl. ..... 52/404; 52/509; 110/336

[58] Field of Search ..... 110/336, 340; 52/506, 52/508, 509, 511, 404; 248/410

[56] References Cited

U.S. PATENT DOCUMENTS

| | | | |
|---|---|---|---|
| 2,893,068 | 7/1959 | Johnson et al. . | |
| 3,312,115 | 4/1967 | Braselmann | 248/410 |
| 3,832,815 | 9/1974 | Balaz et al. . | |
| 3,854,262 | 12/1974 | Brady . | |
| 3,892,396 | 7/1975 | Monaghan | 52/506 |
| 3,952,470 | 4/1976 | Byrd, Jr. . | |
| 3,990,203 | 11/1976 | Greaves . | |
| 4,038,800 | 8/1977 | Daley, Jr. | 52/509 |
| 4,088,825 | 5/1978 | Carr . | |
| 4,222,337 | 9/1980 | Smith . | |
| 4,233,468 | 11/1980 | Northup, Jr. . | |
| 4,287,839 | 9/1981 | Severin et al. . | |
| 4,318,259 | 3/1982 | Verheyden . | |
| 4,336,085 | 6/1982 | Rast | 110/336 |
| 4,336,086 | 6/1982 | Rast . | |
| 4,339,902 | 7/1982 | Cimochowski et al. . | |
| 4,381,634 | 5/1983 | Hounsel et al. . | |
| 4,411,621 | 10/1983 | Miller . | |
| 4,425,749 | 1/1984 | Parker . | |
| 4,440,099 | 4/1984 | Brachet et al. . | |
| 4,449,345 | 5/1984 | Hounsel et al. | 52/506 |
| 4,473,015 | 9/1984 | Hounsel . | |
| 4,494,295 | 1/1985 | Herring . | |
| 4,524,702 | 6/1985 | Miller et al. . | |
| 4,549,382 | 10/1985 | Byrd, Jr. . | |
| 4,605,583 | 8/1986 | Frahme | 52/509 |
| 4,733,620 | 3/1988 | Robbins | 110/336 |
| 4,829,734 | 5/1989 | Schraff | 110/339 |

FOREIGN PATENT DOCUMENTS

| | | | |
|---|---|---|---|
| 0165205 | 4/1985 | European Pat. Off. . | |
| 2424468 | 11/1979 | France . | |
| 2345409 | 11/1980 | France . | |
| 0895472 | 5/1962 | United Kingdom | 110/336 |
| 2042699A | 2/1980 | United Kingdom . | |

*Primary Examiner*—Carl D. Friedman
*Assistant Examiner*—Christopher T. Kent
*Attorney, Agent, or Firm*—D. Peter Hochberg; Mark Kusner

[57] ABSTRACT

Disclosed is a heat chamber wall having an insulating lining comprised of at least one row of modules of heat insulating material. Each module is comprised of a length of material folded over to define at least two side portions with a bight portion. The modules are supported by a module rod extending through its associated module. A mounting clip is secured to the module rod and extends to one side thereof. The clip has an aperture of predetermined configuration extending therethrough along an axis offset and generally perpendicular to the axis of the module rod. Elongated generally straight hangers dimensioned to extend through the aperture in the mounting clip and to bind therewith in locking fashion when the axis of the aperture is tilted relative to the axis of the hanger rod under the elastic compressive force exerted by the modules.

13 Claims, 5 Drawing Sheets

HEAT CHAMBER LINING

FIELD OF THE INVENTION

The present invention pertains generally to a heat chamber lining and more particularly to a lining formed of fibrous blanket material. The invention is particularly applicable for industrial high temperature environments, but may also find advantageous application in lining low temperature, domestic heat chambers, or furnaces.

BACKGROUND OF THE INVENTION

In the construction and operation of various types of furnaces or heating chambers, the inner walls, doors, flues, dampers and roof are typically lined with some type of refractory material or materials, which are capable of withstanding the operating temperatures within the furnace. It has been known to use folded, ceramic fibrous blanket material in lining such furnaces or heat chambers. In such applications, the folded blanket material is secured under elastic compression to prevent separation of the material at the folds due to shrinkage of the material which occurs above a certain temperature.

Several systems for securing the folded ceramic fibrous blanket material (modules) to a walled surface have been developed. In this respect, U.S. Pat. No. 4,411,621 to Miller discloses a furnace wall construction wherein interleaved mats of fibrous insulating material are supported on an expanded sheet metal member by elongated metal rods which are positioned within the folds of the interleaved mats adjacent the closed ends thereof. The metal rods are secured to the expanded metal member by wire ties. As will be appreciated, construction of a wall is labor intensive, generally requiring two workman to mount the modules to the expanded metal member. Moreover, repair of such a wall is time consuming in that each mounting wire tie must be cut to release the mounting rods, then later replaced when a new module is inserted. Still further, such construction requires the use of expanded metal or perforated plate as a support surface. In this respect, it cannot be utilized with flat plates or sheets typically found in many existing furnace structures.

U.S. Pat. No. 4,733,620 discloses an advance in heat chamber linings wherein the modules of fibrous blanket material are mounted on elongated module rods, the ends of which engage and are supported in recesses formed in generally serrated hanger rods. The module rods are held in the recess by the elastic compressive forces exerted on the rods by the modules. While such an arrangement eliminates the necessity of two workman for installation, the specific design of the mounting hangers requires fairly accurate spacing of the hanger rods to insure engagement with the ends of the module rods. Further, such an arrangement limits the compression of the modules to stepped increments established by the spacing of the recesses formed in the serrated hanger rods.

The present invention overcomes these and other problems and provides a wall for a furnace or a heat chamber, and a mounting assembly for mounting fibrous blanket material to a wall, which is adjustable in minute increments, which eliminates heat transferred along a generally continuous rod and which is simple, economical and easy to fabricate and install.

SUMMARY OF THE INVENTION

In accordance with the present invention there is provided a heat chamber wall having an insulating lining comprised of at least one row of modules of heat insulating material. Each module is comprised of a length of material folded over to define at least two side portions with a bight portion. Means for supporting the modules are comprised of a module rod adapted to support each of the modules extending through its associated module and a mounting clip secured to the module rod. The mounting clip extends to one side of the mounting rod with the clip having an aperture of predetermined configuration extending therethrough. The aperture is disposed along an axis offset and generally perpendicular to the axis of the module rod. An elongated, generally straight hanger rod is dimensioned to extend through the aperture in the mounting clip and to bind therewith in locking fashion when the axis of the aperture is tilted relative to the axis of the hanger rod.

In accordance with another aspect of the present invention there is provided a mounting rod for supporting a module of fibrous ceramic blanket material to a wall of a heat chamber having an elongated hanger rod mounted thereto. The mounting rod is comprised of an elongated, straight rod member having at least one generally flat tab extending to one side thereof. The tab is generally flat and disposed in a plane generally parallel to the axis of the module rod. The tab includes an aperture therethrough which extends along an axis offset from and generally perpendicular to the axis of the module rod. The aperture within the mounting clip is dimensioned to receive a hanger rod therethrough and to bind therewith in locking fashion when the axis of the aperture is tilted relative to the axis of the hanger rod.

It is an object of the present invention to provide a mounting assembly for mounting a ceramic blanket module of insulating material to an inner surface, such as a wall or roof or the like, in a furnace or other type heating or heat treating equipment or heat containing vessel.

It is another object of the present invention to provide an improved, ceramic fibrous blanket module for insulating an inner surface of a furnace or the like.

Another object of the present invention is to provide a module which may be prefabricated or field assembled and which requires minimal layout or engineering support.

Another object of the present invention is to provide a module which reduces damage due to conductive heat along module support rods.

Another object of the present invention is to provide a ceramic, fibrous blanket module which is relatively tool free and does not require two workman to assemble.

Another object of the present invention is to provide a module as described above which may be custom sized.

Another object of the present invention is to provide a ceramic, fibrous blanket module which finds advantageous application for use with furnace walls formed from sheet metal, expanded metal or perforated metal.

Another object of the present invention is to provide a wall construction for a heat chamber comprised of a plurality of rolls of modules of ceramic, fibrous blanket material, wherein the compression between adjacent modules may be varible and ajustment is not limited to fixed increments.

Another object of the present invention is to provide a mounting assembly for mounting modules of fibrous blanket material to a support surface of a heat chamber which mounting assembly is easily attached to support surface of a heat chamber.

A still further object of the present invention is to provide a mounting assembly for mounting modules of fibrous blanket material to a support surface of a heat chamber which is relatively simple and easy to fabricate, assemble, install and use.

These and other objects and advantages will become apparent from the following description of preferred embodiments of the invention, taken together with the accompanying drawings.

BRIEF DESCRIPTION OF THE DRAWINGS

The invention may take form in certain parts and arrangement of parts, embodiments of which are described in detail in the specification and illustrated in the accompanying drawings wherein.

DESCRIPTION OF A PREFERRED EMBODIMENT

Figure 1:
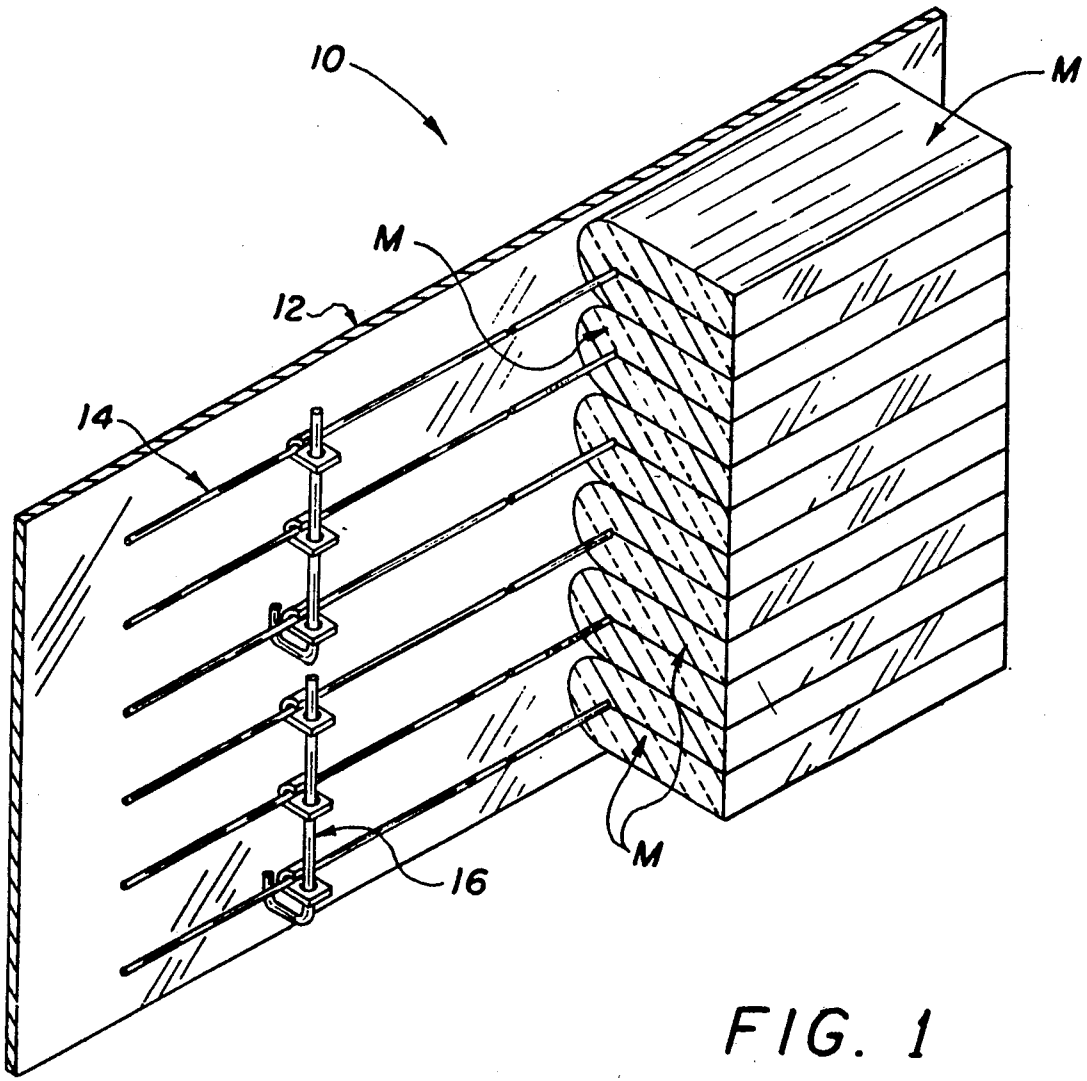
FIG. 1 is a perspective view of a portion of a furnace wall construction, shown partially sectioned, illustrating a preferred embodiment of the present invention.
Figure 2A:
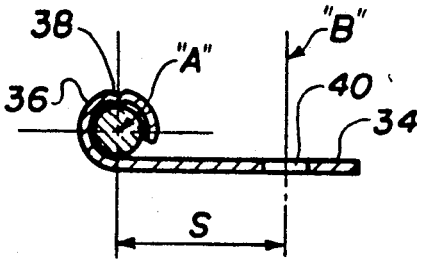
FIG. 2*a* is a sectional, side elevational view of the tab and rod assembly of the present invention.
Figure 2:
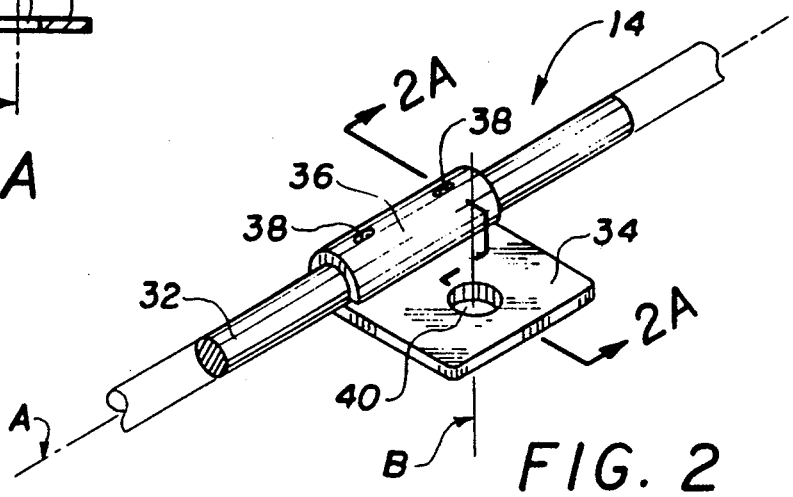
FIG. 2 is a perspective view of a module mounting rod illustrating another aspect of the present invention.
Figure 3:
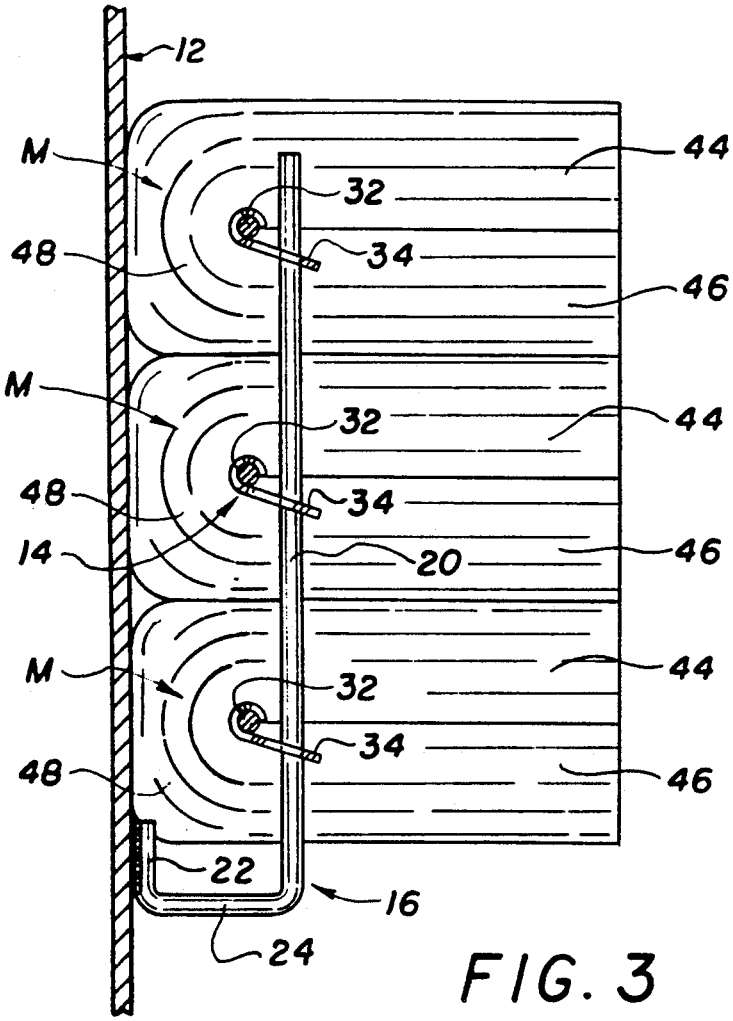
FIG. 3 is a sectional, side elevational view of the wall construction shown in FIG. 1.

Referring now in greater detail to the drawings, wherein the showings are for the purpose of illustrating preferred embodiments of the invention only, and not for limiting the invention, FIGS. 1-3 illustrate a wall construction 10 for a furnace or the like according to the present invention. Wall 10 is comprised of a plurality of modules M of fibrous ceramic insulating material mounted to a support surface 12 by means of module support rods 14 and stack pins 16.

According to the present invention, support surface 12 may be formed of expanded metal, perforated metal plate or a solid plate. In the embodiment shown, support surface 12 is a solid, generally planar plate. It will be appreciated, however, that such plate may be bent, broken or have a custom contoured form without deviating from the present invention. Stack pins 16 (best seen in FIG. 3) are generally J-shaped and include an elongated rod support leg 20, a shorter mounting leg 22 and an intermediate spacer leg 24. Mounting leg 22 is provided to be fixedly or releasibly secured to support surface 12. In the embodiment shown, mounting leg 22 is preferably secured to support surface 12 by welding, as illustrated in FIG. 3. Stack pins 16 are preferably arranged in side-by-side, spaced-apart relationship with upper stack pins 16 being aligned with stack pins 16 therebelow, as illustrated in FIG. 1. As will be appreciated from a further reading of the present specification, however, stack pins 16 may be arranged in a staggered pattern without deviating from the present invention. Stack pins 16 are preferably formed of a high temperature stainless steel, and in the embodiment shown are formed of a circular rod having an outer diameter of approximately ¼". Referring now to FIG. 2, module rod 14 is best seen. Module rod 14 is comprised of an elongated straight rod 32 of predetermined length having a mounting clip or tab 34 extending to one side thereof. In the embodiment shown, rod 32 is shown as a circular rod but may be a rod having a rectangular cross section without deviating from the present invention. Tab 34 is basically comprised of a flat planar strap formed at one end into a sleeve 36 having an opening dimensioned to receive rod 32 therein. Tab 34 is fixedly secured to rod 32 at the mid-point between the ends thereof. Tab 34 may be tack welded to rod 32 or, as shown in FIG. 2, may be secured to rod 32 by deforming sleeve 36 into the outer surface of rod 32 by a stamping or forging operation. To this end, FIG. 2 shows sleeve 36 having depressions 38 stamped therein which depressions cause the inner surface of sleeve 36 to penetrate onto the surface of rod 32 securing sleeve 36 thereto.

Referring now to FIG. 2A, tab 34 is preferably oriented to lie in a plane which is generally parallel to the axis of rod 32, which axis is designated A in the drawings. Tab 34 includes an aperture 40 projecting therethrough. Aperture 40 is aligned along an axis "B" which is disposed a predetermined distance "S" from axis "A" of rod 32 and extends generally perpendicular thereto as best seen in FIG. 2A. According to the present invention, aperture 40 is dimensioned to be slightly larger in diameter than support leg 20 of stack pins 16.

Wall construction 10 is formed by arranging a plurality of modules M against support structure 12 as illustrated in FIG. 2. Specifically, modules M are long, rectangular pieces of fibrous ceramic blanket, bat, mat, or similar high temperature material. Such material is conventionally known and is readily available in various standard sizes, thickness and density. According to the present invention, each module M is folded over a module rod 14 such that two side portions, designated 44, 46 in the drawings, are created, which side portions 44, 46 are side-by-side. A fold or bight portion 48 is formed at one end of side portions 44, 46. A module rod 14 is adapted to be positioned within the fold of each module M and to be mounted with stack pins 16 extending through aperture 40 and tab 34. In this respect, tab 34 and intermediate leg 24 of hanger rod 16 are dimensioned such that bight portion 48 is positioned snugly against support surface 12. Holes or slots (not shown) may be cut in module M to facilitate the positioning thereof on module rods 14 and stack pins 16.

As is well known in the art with such wall construction, it is desirable to compress modules M into engagement with each other to produce a desired degree of compression between adjacent modules M and side portions 44, 46 of a given module M. According to the present invention, compression of modules M is easily accomplished by forcing the modules into compression along hanger rod 14. In this respect, the inherent elasticity of the fibrous modules M creates a force acting to move modules M and mounting rods 14 away from each other. This inherent elastic force creates a moment arm about aperture 40 of tab 34 thereby causing tab 34 to be tilted or cocked relative to the axis of rod support leg 20. In other words, because aperture 40 is slightly larger than the outer diameter of rod support leg 20, tab 34 becomes kinked relative thereto such that tab 34 becomes locked onto rod support leg 20 as a result of the moment exerted thereon by modules M. Thus, once modules M are compressed to the desired compression, tab 34 locks module M on rod support leg 20 and prevents further expansion or separation of adjacent modules M. As will be appreciated, the compression on modules M can be relieved mechanically if necessary, to repair or reposition same.

FIGS. 1 through 3 illustrate a preferred embodiment of the present invention wherein an individual module rod 14 includes a centrally located tab for locking the rod 14 onto stack pins 16. According to one aspect of the present invention, the uniform size of module rod 14 facilitates easy assembly of a wall construction 10 in an existing furnace or heat chamber through use of the rod 16 as a locating tool. In this respect, once a given column of stack pins 16 are aligned and secured vertically along support surface 12, the position of laterally adjacent hanger rods 16 can be easily determined utilizing module rod 14 as a spacing component. By placing module rod 14 on a hanger 16 (i.e. inserting tab 34 to hanger rod 16), and by positioning another mounting rod 14 in end-to-end alignment with the mounted module rod 14, the position of the next hanger rod 16 is established by the position of aperture 40 in the second module rods. In other words, if a plurality of rod 14 are aligned end-to-end, the location of apertures 40 in tabs 34 establishes the appropriate location for stack pins 16. Thus, by using module rods 14 as a spacer and guide, subsequent stack pins 16 can be located and positioned along a support wall to facilitate quick and easy assembly of a wall construction 10. In this respect, in the event that an obstruction, such as an access port, wall or the like prevents positioning of a module rod 14, such module rod 14 may be easily and quickly cut to an appropriate length to accommodate such obstruction and to maintain the continuity of the wall construction.

Figure 4:
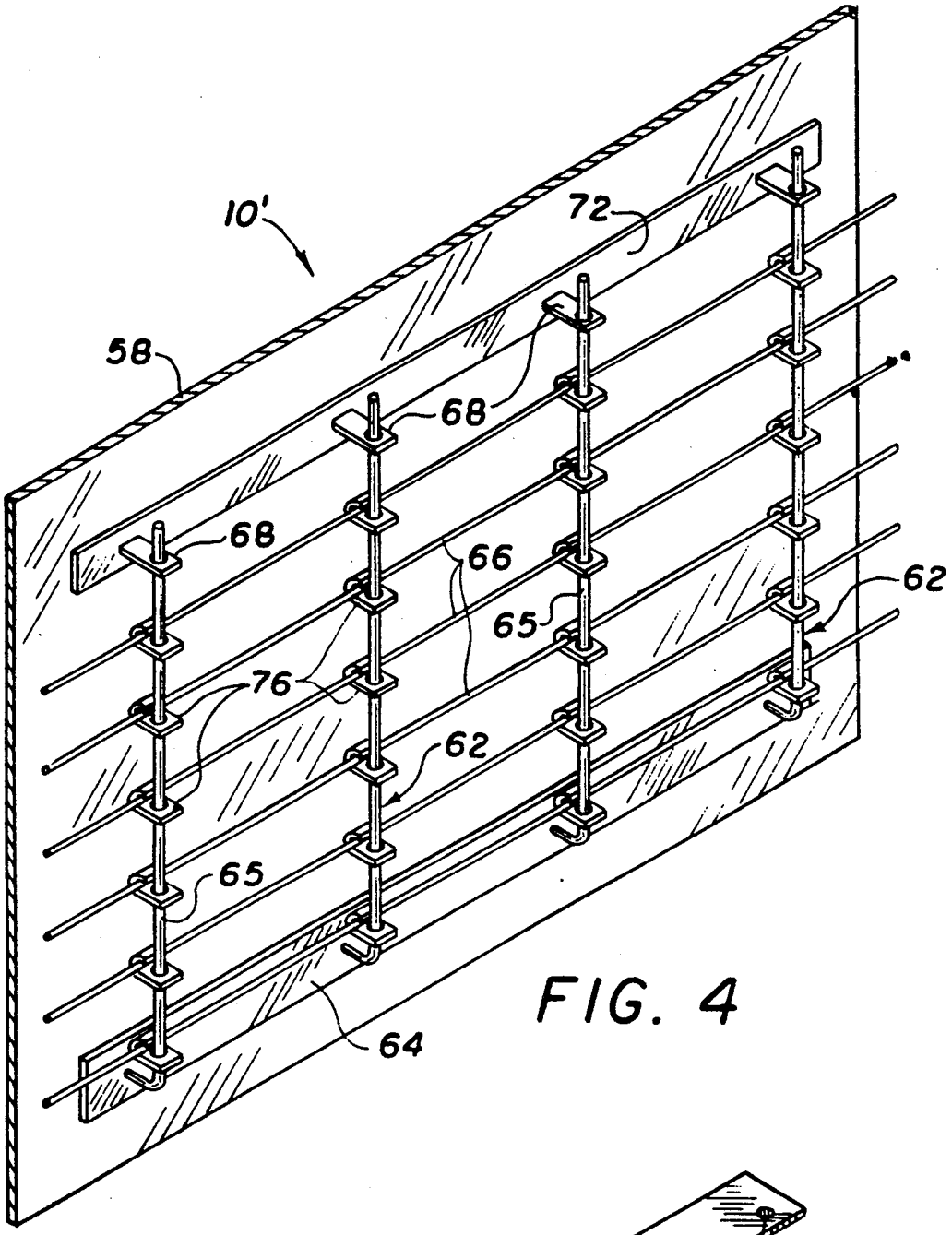
FIG. 4 is a perspective view of a wall construction (without modules of fibrous blanket material) illustrating other embodiments of the present invention.
Figure 5:
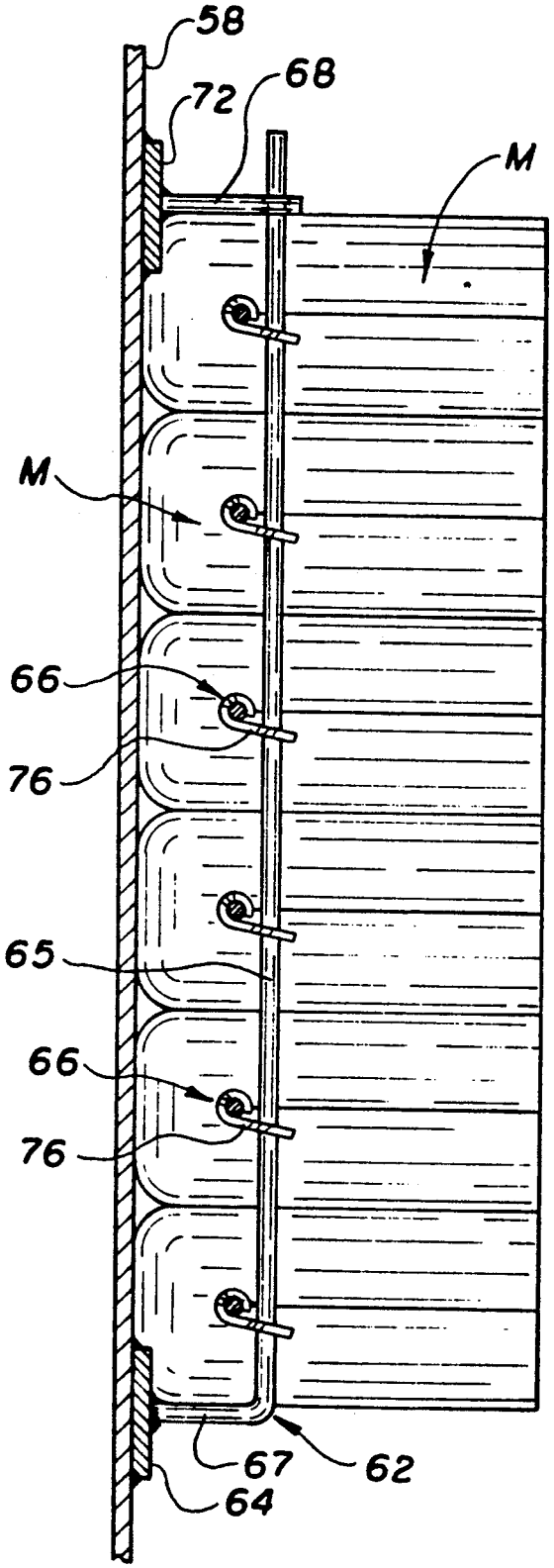
FIG. 5 is a sectional, side elevational view showing a wall construction according to the present invention utilizing the embodiment shown in FIG. 4.

FIGS. 4–5 illustrate alternate embodiments of the present invention which find advantageous application for expanded metal or perforated wall units or prefabrication of stack pins 62 assemblies. In this respect, FIG. 4 shows a wall construction 10′ comprised of a support surface 58, a plurality of support posts 62 which are secured to a mounting plate 64, a plurality of module support rods 66, and a plurality of locating elements 68 secured to a mounting plate 72. Support posts 62 (best seen in FIG. 5) are generally L-shaped and have an elongated support leg 65 and shorter mounting leg 67. Support posts 62 are dimensioned to be spaced-apart along plate 64 and to be fixedly secured thereto. Posts 62 are preferably secured to mounting plate 64 by welding as shown in the drawings. Mounting plate 64 is preferably formed of a flat plate which facilitates being fixedly or releasibly secured to a support surface 58, as shown in FIG. 4, or to a support surface formed of expanded or perforated metal.

Rod support leg 65 of support posts 62 are adapted to be generally parallel to support surface 58 as best seen in FIG. 5. In the embodiment shown, module support rod 66 each include a plurality of tabs 76 mounted thereon. Tabs 76 are similar to tabs 34, shown in FIG. 2 and described previously. Tabs 76 are spaced-apart on rods 66 to be in registry with support legs 65 of support posts 62. To prevent lateral deflection or movement of elongated rod support leg 65 of support posts 62, locating elements 68 are provided. Locating elements 68 are basically comprised of a flat bar having an aperture formed therein. The aperture in locating elements 68 are dimensioned to closely approximate the diameter of legs 65 of support posts 62 and to receive legs 65 therein. Locating elements 68 are secured to mounting plate 72, such that the apertures in locating elements 68 are in registry with support posts 62 as illustrated in FIG. 4. Mounting plate 72 is preferably flat to facilitate mounting to support surface 58.

A wall construction 10′ containing a plurality of modules M is best seen in FIG. 5. In this embodiment, elongated support leg portion 65 of support posts 62 provides an elongated mounting surface for the tabs 76 of module support rods 66.

Figure 4A:
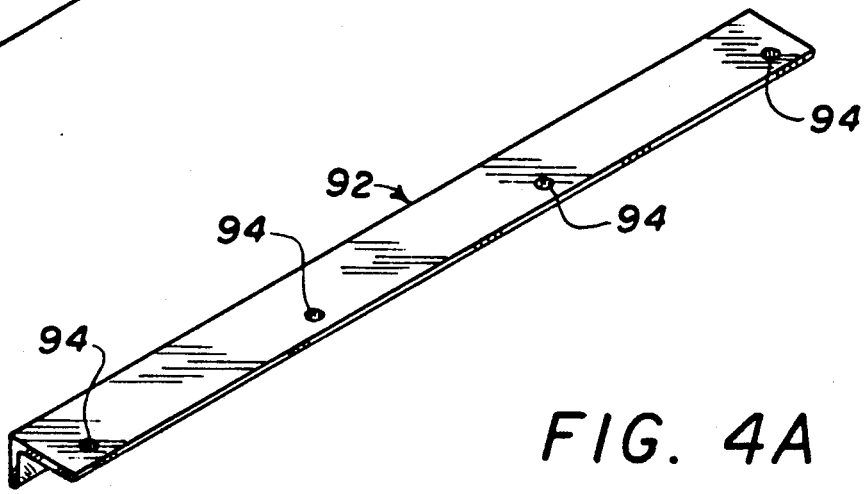
FIG. 4A is a perspective view of a spacer which may be used in conjunction with the embodiment shown in FIG. 4.

Module supporting rods 66 operate in conjunction with support posts 62 in a manner as previously described wherein tabs 76 lock onto the elongated rod support legs 65 of support posts 62. Locating elements 68 maintains structural integrity and the position of the relatively long rod support leg 65. FIG. 4A illustrates an alternate embodiment to locating elements 68 and mounting plate 72 and discloses a locating element 92 comprised of an angle having a plurality of apertures 94 formed therein. Apertures 94 are spaced-apart and dimensioned so as to be in registry with support posts 62. FIGS. 3 through 5 thus illustrate alternate embodiments wherein depending upon the nature of the wall construction, a module rod may have one or more mounting tabs 76 to facilitate more rapid installation of wall construction 10′. In this respect, FIGS. 3 through 5 illustrates alternate embodiments of the present invention which provides greater utilization and economy of material and at the same time providing a rigid support structure for module supporting rods 66. While FIGS. 4 and 5 illustrate a module support rod 66 including a plurality of tabs 76 thereon, it will be appreciated that shorter module support rods 14, as illustrated in FIGS. 1, 2 and 3 may also be used with the longer support posts 62, shown in FIGS. 4 and 5.

The present invention thus provides a simple, yet effective, method of forming a wall construction for a furnace or heating chamber. Importantly, according to the present invention, the degree of compression is variable between adjacent modules M and is not limited to incremental steps of compression as in prior art.

Figure 6:
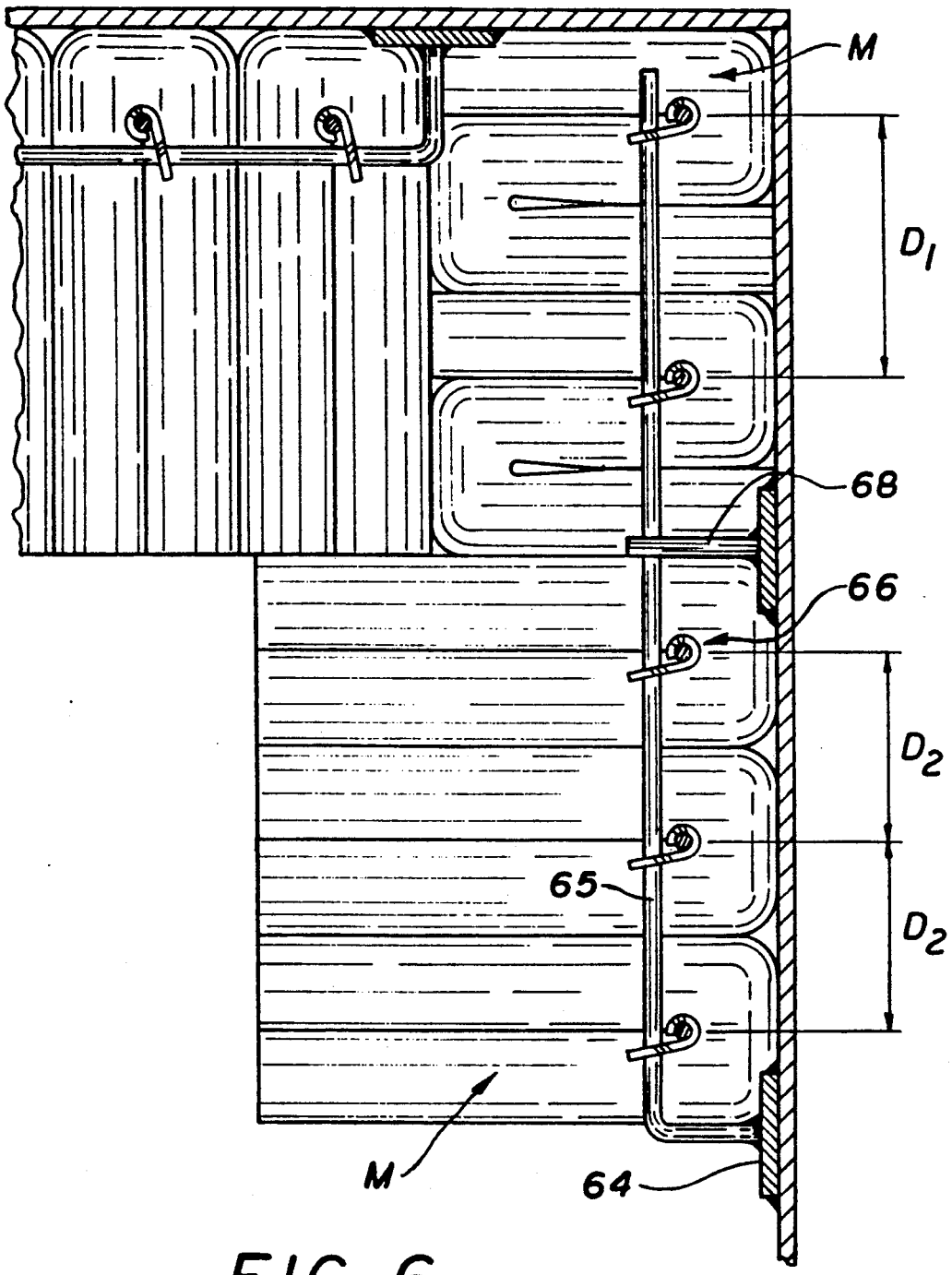
FIG. 6 is a view of a wall assembly illustrating applications of the present invention.

In this respect, FIG. 6 illustrates a furnace wall construction and a ceiling construction in elevation (or two sidewalls in plan view) illustrating the advantages of the present invention. Specifically, FIG. 6 illustrates how on a given support rod or wall unit, the spacing between adjacent module support rods may vary depending upon the size, thickness and number of folds of modules M. In this respect, the lower portion of the wall construction is shown with modules M having a single fold, whereas upper portion of the wall construction shows modules M with two folds. As shown, the spacing between module support rods in the upper portion is necessarily greater than the spacing between such rods in the lower portion of the wall construction. The present invention facilitates such differences in spacing and provides versatility in the formation and creation of wall units.

The present invention has been described with respect to preferred embodiments. Modifications and alterations will occur to others upon their reading and understanding of the specification. For example, while the present invention has been described generally with respect to circular rods, elongated rods of various cross sections may be utilized without deviating from the present invention. It is intended that all such modifications and alterations be included insofar as they come within the scope of the patent as claimed or the equivalents thereof.

Having described the invention, the following is claimed:

1. A heat chamber wall having:

an insulating lining, comprised of at least one row of modules of heat insulating material, each of said modules comprised of a length of material folded over to define two side portions with a bight portion, and means for supporting said modules comprising:

a module rod having a longitudinal axis, said module rod adapted to support each of said modules extending through its associated module;

a mounting clip secured to said module rod and extending outward from said module rod, said clip having an aperture of predetermined configuration formed therethrough along a predetermined axis which is offset and generally perpendicular to the longitudinal axis of said rod, and hanger means having an elongated straight portion dimensioned to extend through said aperture in said mounting clip and to bind therewith in locking fashion when the axis of said aperture is tilted relative to the axis of said hanger.

2. A heat chamber wall as defined in claim 1 wherein said hanger means is a generally J-shaped rod.

3. A heat chamber wall as defined in claim 1 wherein said wall includes a support surface formed from a solid metal, perforated metal plate or expanded metal.

4. A heat chamber wall as defined in claim 3 wherein said hanger means is secured to said support surface.

5. A heat chamber wall as defined in claim 1 wherein said module rod includes a plurality of mounting clips thereon and said hanger means includes a plurality of straight portions operatively engaging said mounting clips.

6. A wall of a heat chamber comprising a support surface and a heat insulating lining extending generally parallel to the support surface, the lining being formed of at least one row of modules of fibrous ceramic heat insulating material, each of said modules comprising an elongated module rod having a longitudinal axis and a length of material folded over said module rod to define two side portions with a bight portion, the modules being arranged in side-by-side relation with said module rods extending generally parallel to each other and with the bight portions located adjacent to said support surface, each of said module rods including at least one mounting tab extending outward from each of said module rods, said tab having an aperture formed therethrough along a predetermined axis which is offset and generally perpendicular to the longitudinal axis of said rod, elongated stack pin means passing through said modules having at least one straight pin portion dimensioned to be received within said aperture in said tab, said aperture dimensioned such that said tab is lockable on said pin portion by causing said tab to be cocked relative to said straight pin portion so as to bind therewith.

7. A wall as defined in claim 6 including a generally planar support surface, said stack pin means being operatively secured thereto.

8. A wall as defined in claim 7 wherein said stack pin means is a generally J-shaped rod having an elongated straight support portion, said rod secured to said support surface with said support portion generally parallel thereto.

9. A mounting rod for supporting a module of fibrous ceramic blanket material to a heat chamber having an elongated hanger rod mounted thereto, said mounting rod comprising:

an elongated straight rod having a longitudinal axis and at least one generally flat clip extending from said rod which is aligned in a plane generally parallel to the longitudinal axis thereof, said clip having an aperture formed therethrough along a predetermined axis which is offset from the longitudinal axis of said rod, said aperture operable to receive a hanger rod therethrough.

10. A mounting rod as defined in claim 9 having a cylindrical cross-section.

11. A mounting rod as defined in claim 9 wherein said clip is a generally flat strap attached to said straight rod.

12. A mounting rod as defined in claim 9 wherein said strap is formed to have a sleeve at one end thereof, said straight sleeve dimensioned to receive said rod.

13. A mounting rod as defined in claim 9 wherein said clip is disposed at the mid point of said straight rod.

* * * * *